US011808464B2

(12) United States Patent
Lei

(10) Patent No.: US 11,808,464 B2
(45) Date of Patent: Nov. 7, 2023

(54) AIR CONDITIONER INDOOR UNIT AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventor: Junjie Lei, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/704,233

(22) Filed: Mar. 25, 2022

(65) Prior Publication Data

US 2022/0214051 A1 Jul. 7, 2022

Related U.S. Application Data

(63) Continuation of application No. PCT/CN2020/078834, filed on Mar. 11, 2020.

(30) Foreign Application Priority Data

Oct. 30, 2019 (CN) ..... 201911057167.0
Oct. 30, 2019 (CN) ..... 201921852128.5

(51) Int. Cl.
*F24F 1/0011* (2019.01)
*F24F 1/0087* (2019.01)
(Continued)

(52) U.S. Cl.
CPC ..... *F24F 1/0011* (2013.01); *F24F 1/0063* (2019.02); *F24F 1/0083* (2019.02); *F24F 1/0087* (2019.02)

(58) Field of Classification Search
CPC ..... F24F 1/0011; F24F 1/0018; F24F 1/0087; F24F 1/0083; F24F 1/0063; F24F 1/0022; F24F 1/0025
See application file for complete search history.

(56) References Cited

U.S. PATENT DOCUMENTS

2018/0128275 A1* 5/2018 Lin ..... F04D 29/5826

FOREIGN PATENT DOCUMENTS

CN 201377863 Y 1/2010
CN 202452604 U 9/2012
(Continued)

OTHER PUBLICATIONS

Machine translation of CN109237625 (Year: 2019).*
(Continued)

*Primary Examiner* — Joseph F Trpisovsky
(74) *Attorney, Agent, or Firm* — Scully, Scott, Murphy & Presser, P.C

(57) ABSTRACT

An air conditioner indoor unit is provided. The indoor unit has a housing, a volute and a first heat exchanger. The housing is provided with an installation cavity. The volute is installed in the installation cavity. An air outlet of the volute is inclined towards a bottom of the installation cavity. The first heat exchanger is installed in the installation cavity corresponding to the air outlet. The first heat exchanger extends from a bottom of the volute to a top of the volute. An air inlet cavity is defined by the volute, the first heat exchanger and the bottom of the installation cavity.

14 Claims, 11 Drawing Sheets

(51) Int. Cl.
*F24F 1/0083* (2019.01)
*F24F 1/0063* (2019.01)

(56) References Cited

FOREIGN PATENT DOCUMENTS

| | | | | | |
|---|---|---|---|---|---|
| CN | 103267341 | A | | 8/2013 | |
| CN | 105066251 | A | | 11/2015 | |
| CN | 106523434 | A | | 3/2017 | |
| CN | 106839086 | A | | 6/2017 | |
| CN | 108489156 | A | | 9/2018 | |
| CN | 108758811 | A | | 11/2018 | |
| CN | 109237625 | A | * | 1/2019 | ..... F24F 1/0007 |
| CN | 208620440 | U | | 3/2019 | |
| CN | 209042572 | U | | 6/2019 | |
| CN | 109974115 | A | | 7/2019 | |
| EP | 2 402 669 | A2 | | 1/2012 | |
| JP | 2017-179191 | A | | 10/2017 | |
| KR | 20080001311 | A | * | 1/2008 | ..... F24F 1/0063 |

OTHER PUBLICATIONS

Supplementary European Search Report dated Sep. 20, 2022 received in European Patent Application No. EP 20882223.9.
International Search Report and Written Opinion dated Jul. 27, 2020 received in International Application No. PCT/CN2020/078834 together with an English language translation.

* cited by examiner

AIR CONDITIONER INDOOR UNIT AND AIR CONDITIONER

CROSS-REFERENCE TO RELATED APPLICATIONS

This application is a continuation application of PCT International Application No. PCT/CN2020/078834, filed on Mar. 11, 2020, which claims priority to and benefits of Chinese Patent Application No. 201921852128.5, filed on Oct. 30, 2019, entitled "AIR CONDITIONER INDOOR UNIT", and Chinese Patent Application No. 201911057167.0, filed on Oct. 30, 2019, entitled "AIR CONDITIONER INDOOR UNIT", the entire contents of which are incorporated in this application by reference for all purposes. No new matter has been introduced.

FIELD

The present disclosure relates to the technical field of air conditioners, and in particular, to an air conditioner indoor unit and an air conditioner.

BACKGROUND

With the improvement of people's living standards, the use of air conditioners is becoming increasingly common, and people have stricter requirements for air conditioners, such as energy efficiency. In the existing air duct machine, the direction of the air outlet of the volute and the arrangement of the indoor heat exchanger are unreasonable, such that the airflow flowing out of the volute cannot exchange heat well with the indoor heat exchanger, so that the heat exchange effect of the heat exchanger is poor.

SUMMARY

The main objective of the present disclosure is to provide an air conditioner indoor unit, which aims to improve the heat exchange effect of the heat exchanger.

In order to at least achieve the above purpose, the present disclosure provides an air conditioner indoor unit, including:

a housing provided with an installation cavity;

a volute installed in the installation cavity, an air outlet of the volute being inclined towards a bottom of the installation cavity; and a first heat exchanger installed in the installation cavity corresponding to the air outlet, the first heat exchanger being extended from a bottom of the volute to a top of the volute, to form an air inlet cavity defined by the volute, the first heat exchanger and the bottom of the installation cavity.

In an embodiment, the top of the volute has a curved surface segment and a straight surface segment connected with the curved surface segment, and the straight surface segment is sloped downward relative to a tangent to a top of the curved surface segment.

In an embodiment, the curved surface segment is smoothly connected with the straight surface segment.

In an embodiment, an angle between a direction of the air outlet of the volute and an inclination direction of the first heat exchanger is at least 135° and no more than 150°.

In an embodiment, the top of the volute has a curved surface segment and a straight surface segment connected with the curved surface segment, an angle between the straight surface segment and a tangential plane at a top of the curved surface segment is at least 5° and not more than 10°; and/or an angle between the first heat exchanger and the bottom of the installation cavity is at least 40° and no more than 50°.

In an embodiment, the air conditioner indoor unit further includes a second heat exchanger, the second heat exchanger is connected in series or in parallel with the first heat exchanger in a refrigerant loop of an air conditioner, and the second heat exchanger is located on a side of the first heat exchanger away from the volute.

In an embodiment, the second heat exchanger is s provided vertically.

In an embodiment, the air conditioner indoor unit further includes a connection plate, one side of the connection plate is fixedly connected with a first side plate of the first heat exchanger, and another side of the connection plate is fixedly connected with a second side plate of the second heat exchanger.

In an embodiment, the connection plate is in parallel with the first side plate and the second side plate, the first side plate and the second side plate are provided with installation holes for installing a refrigerant pipe, fastening lugs are respectively provided on adjacent or opposite sides of the connection plate, and the fastening lugs are extended between two adjacent installation holes and are fastened to corresponding side plates through fasteners.

In an embodiment, one or more of the connection plate, the first side plate and the second side plate are fixedly connected to an end of the housing.

In an embodiment, a bottom of the first heat exchanger and/or a bottom of the second heat exchanger is fixedly connected to a bottom of the housing.

In an embodiment, the air conditioner indoor unit further includes a water receiving tray, the water receiving tray is located directly below the first heat exchanger, and the water receiving tray is fixedly connected with the bottom of the housing.

In technical solutions of the present disclosure, the air outlet of the volute is inclined towards the bottom of the installation cavity, and the first heat exchanger is inclined along the inclination trend of the air outlet of the volute, such that the airflow from the volute has a component that flows along the inlet side of the first heat exchanger, the airflow can fill the air inlet side of the first heat exchanger and pass through the first heat exchanger under the action of the horizontal component of the airflow. Thus, the heat exchange time and heat exchange efficiency between the air and the first heat exchanger are greatly improved, which is beneficial to improve the energy efficiency of the air conditioner. Since the air outlet of the volute is inclined downward, the downward angle of the first heat exchanger can be reduced (the angle with the bottom of the housing is increased), which facilitates the installation of the first heat exchanger (the horizontal distance between the center of gravity of the first heat exchanger and the support position of the bottom of the first heat exchanger is reduced). The inclination of the first heat exchanger is beneficial to increase the heat exchange area of the first heat exchanger, thereby improving the heat exchange efficiency.

BRIEF DESCRIPTION OF THE DRAWINGS

In order to more clearly illustrate the technical solutions of the embodiments of the present disclosure or the prior art, the following will briefly introduce the accompanying drawings that need to be used in the description of the embodiments or the prior art. Obviously, the drawings in the following description are only some embodiments of the present disclosure. For those of ordinary skill in the art, other drawings can also be obtained based on the structures shown in these drawings without any creative effort.

Figure 1:
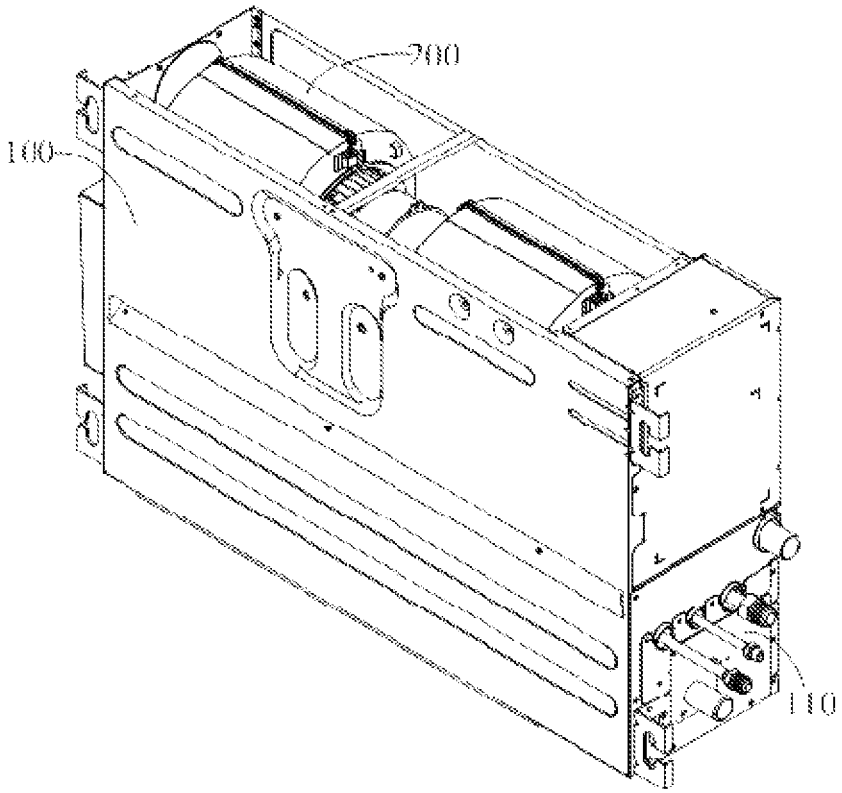
FIG. 1 is a schematic structural view of an air conditioner indoor unit according to an embodiment of the present disclosure.

Description of reference signs shown in the figures is provided in the following table.

TABLE 1

| Reference sign | Name | Reference sign | Name |
|---|---|---|---|
| 100 | housing | 110 | end plate |
| 111 | mounting plate | 112 | pressing pipe plate |
| 200 | fan | 210 | volute |
| 211 | curved surface segment | 212 | straight surface segment |
| 220 | wind wheel | 230 | motor |
| 250 | air outlet | 270 | fastening plate |
| 300 | muffler | 400 | humidification pipe |
| 500 | indoor heat exchanger | 510 | first heat exchanger |
| 511 | first side plate | 520 | second heat exchanger |
| 521 | second side plate | 530 | connection plate |
| 531 | fastening lug | 600 | siphon device |
| 700 | water receiving tray | | |

The realization of the objective, functional characteristics, and advantages of the present disclosure are further described with reference to the accompanying drawings.

DETAILED DESCRIPTION OF EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

Besides, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. The meaning of "and/or" appearing in the disclosure includes three parallel scenarios. For example, "A and/or B" includes only A, or only B, or both A and B. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides an air conditioner indoor unit. There are many forms of air conditioner indoor unit, such as wall-mounted air conditioner indoor unit, floor-standing air conditioner indoor unit, or the like. The positional relationship between the air outlet direction of the volute 210 and the indoor heat exchanger 500 can be adjusted, such that the airflow may extend along the surface of the heat exchanger and pass through the heat exchanger to increase the heat exchanger efficiency of the airflow and the heat exchanger.

The specific structure of the air conditioner indoor unit will be mainly described below.

Figure 2:
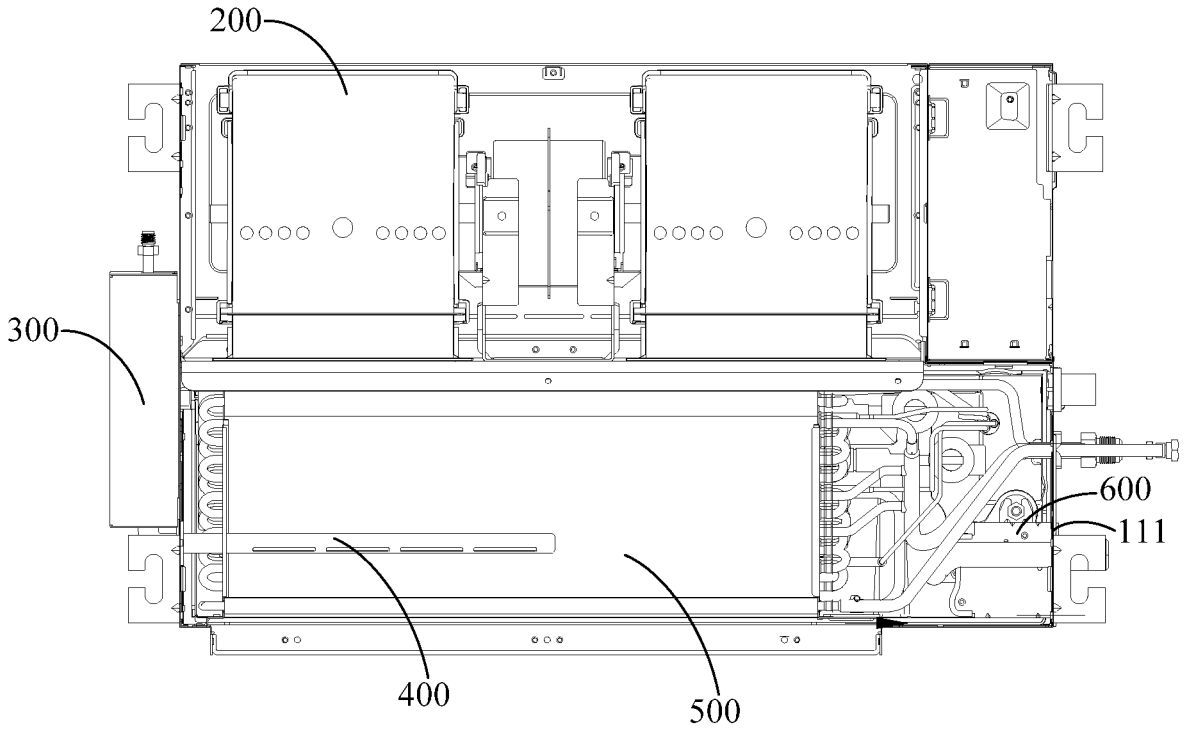
FIG. 2 is an internal schematic structural view of FIG. 1.
Figure 3:
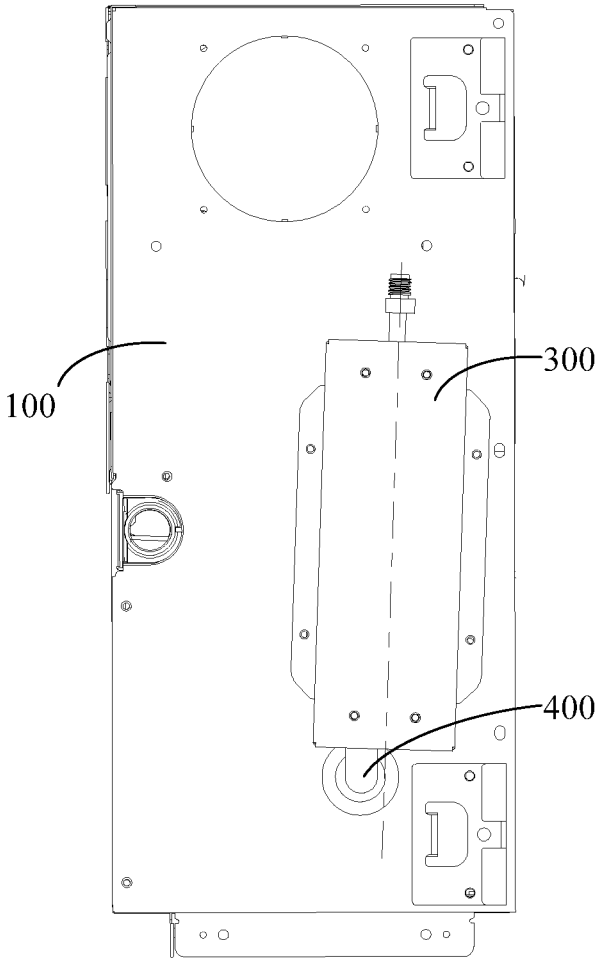
FIG. 3 is a left side view of FIG. 2.
Figure 4:
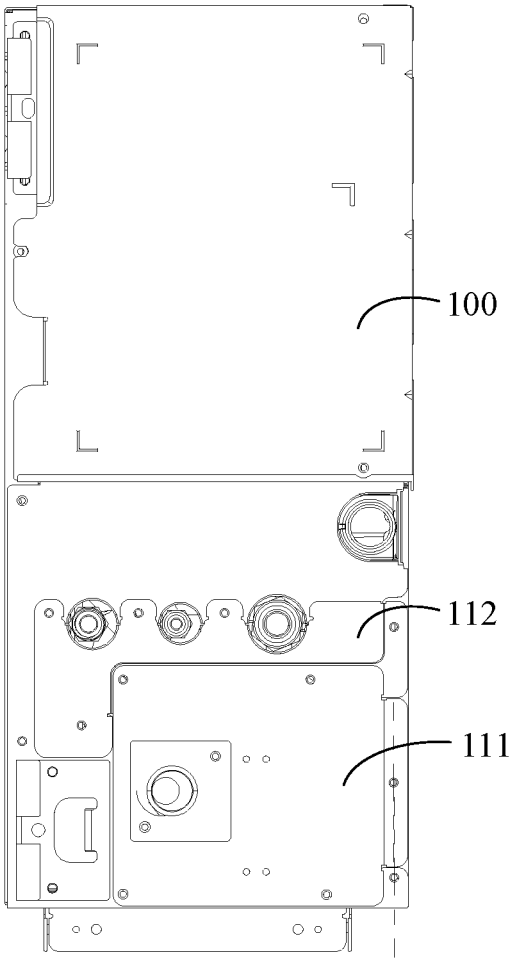
FIG. 4 is a right side view of FIG. 2.
Figure 5:
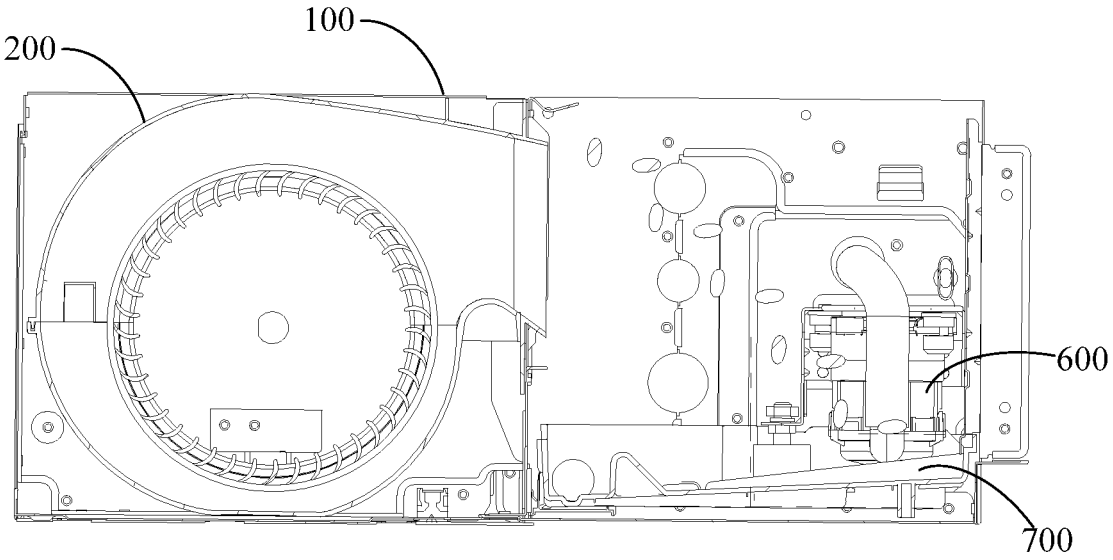
FIG. 5 is a schematic structural view of the air conditioner indoor unit according to another embodiment of the present disclosure.
Figure 6:
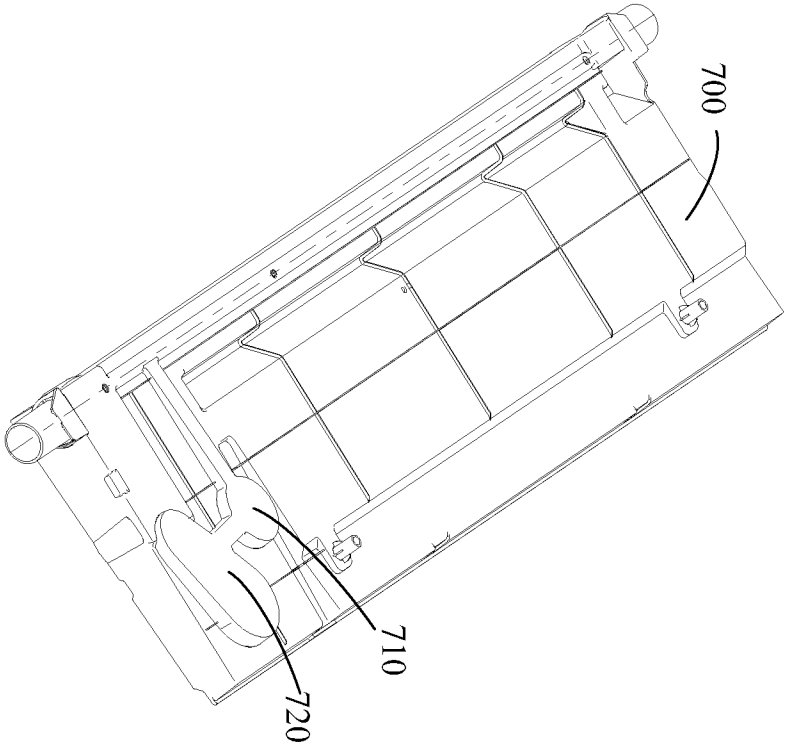
FIG. 6 is a schematic structural view of a water receiving tray of the air conditioner indoor unit of the present disclosure.
Figure 7:
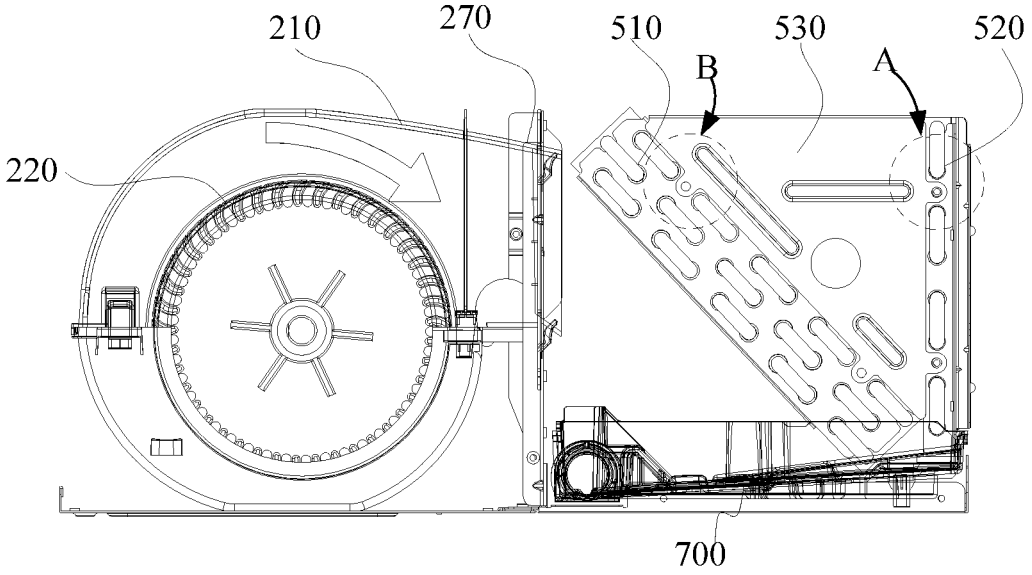
FIG. 7 is a schematic view of a positional relationship between a fan and an indoor heat exchanger of the air conditioner indoor unit according to an embodiment of the present disclosure.
Figure 8:
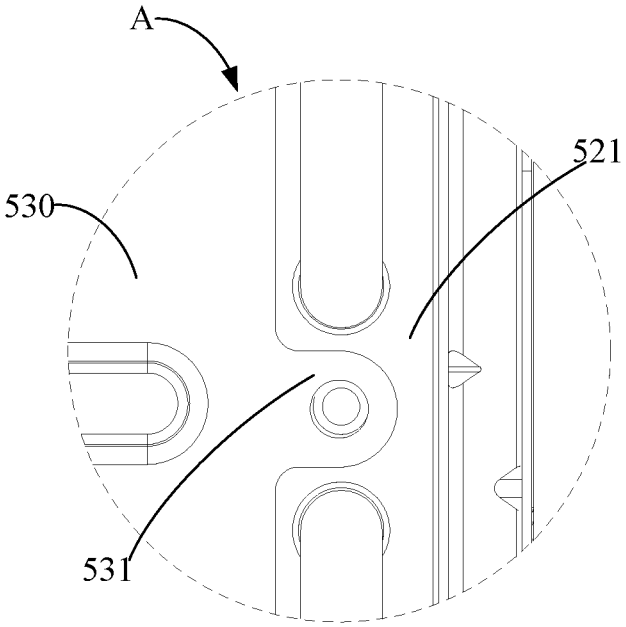
FIG. 8 is a partial enlarged view of portion A in FIG. 7.
Figure 9:
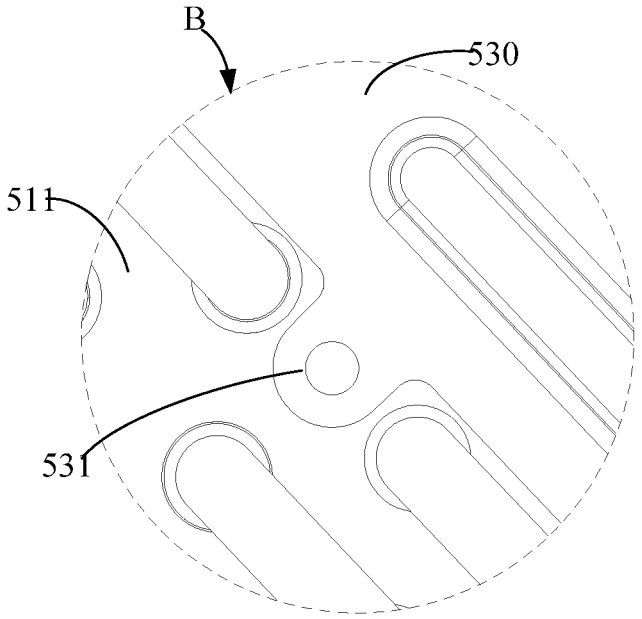
FIG. 9 is a partial enlarged view of portion B in FIG. 7.
Figure 10:
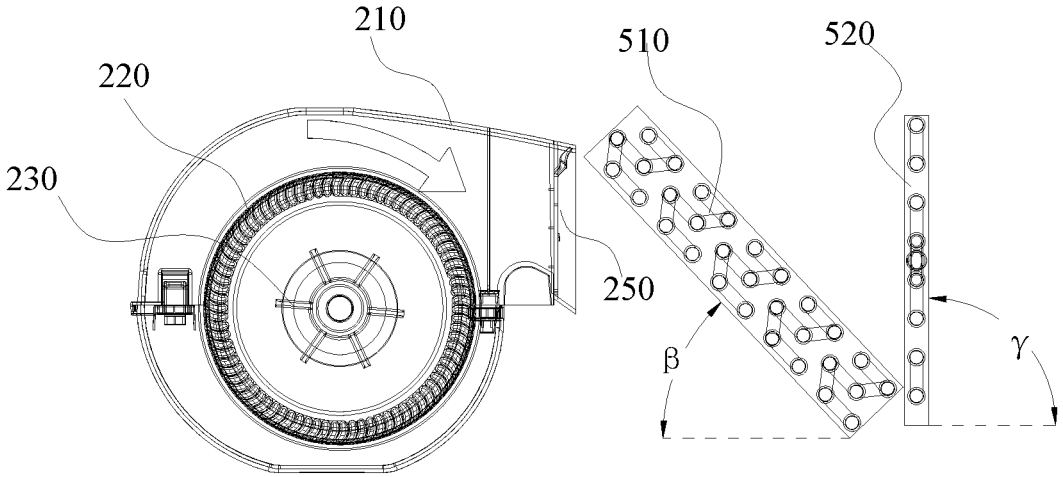
FIG. 10 is a schematic view of a positional relationship between the fan and the indoor heat exchanger of the air conditioner indoor unit according to another embodiment of the present disclosure.
Figure 11:
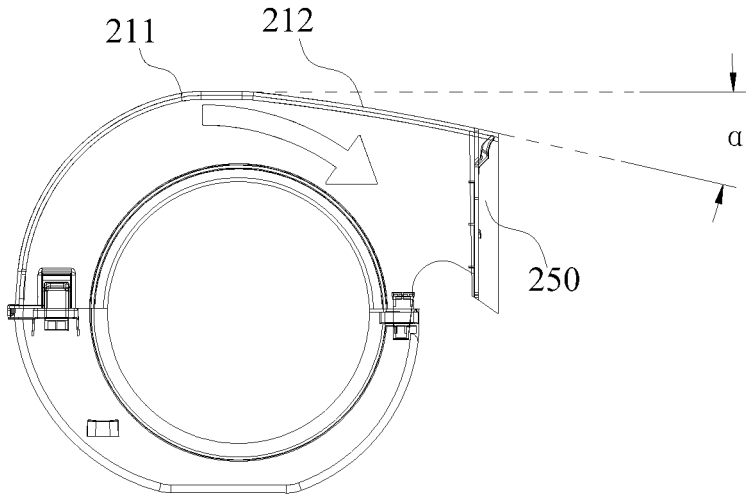
FIG. 11 is a schematic structural view of a volute of the air conditioner indoor unit of the present disclosure.

As shown in FIG. 1 to FIG. 11, in an embodiment of the present disclosure, the air conditioner indoor unit includes:

- a housing 100 provided with an installation cavity;
- a volute 210 installed in the installation cavity, an air outlet 250 of the volute 210 being inclined towards a bottom of the installation cavity; and
- a first heat exchanger 510 installed in the installation cavity corresponding to the air outlet, the first heat exchanger 510 being extended from a bottom of the volute 210 to a top of the volute 210, to form an air inlet cavity defined by the volute 210, the first heat exchanger 510 and the bottom of the installation cavity.

For example, in this embodiment, the air conditioner indoor unit is described by taking the air conditioner indoor unit with one or more ducts as an example. The overall shape of the housing 100 can have many shapes, such as cuboid-like (on the basis of cuboid, depressions, protrusions, and openings are provided according to actual needs), cylindrical, or the like. The housing 100 has an air inlet, an air outlet, and an air duct communicating the air inlet with the air outlet. Both the fan 200 and the indoor heat exchanger 500 are installed in the installation cavity, and in some embodiments, the installation cavity is a part of the air duct. The air conditioner indoor unit includes a first heat exchanger 510, and in some embodiments, can include both a first heat exchanger 510 and a second heat exchanger 520. The first heat exchanger 510 and the second heat exchanger 520 are provided in parallel in the refrigerant loop, and can also be provided in series in the refrigerant loop. Regardless of whether the first heat exchanger 510 and the second heat exchanger 520 are connected in series or in parallel, by setting a reasonable outdoor refrigerant flow path, the working modes of the first heat exchanger 510 and the second heat exchanger 520 are different or the same. That is, the first heat exchanger 510 and the second heat exchanger 520 can simultaneously cool and heat; or one can cool and the other one can heat.

The fan 200 includes a volute 210 and a wind wheel 220 provided in the volute 210, the motor 230 drives the wind wheel 220 to rotate, and a negative pressure area and a positive pressure area are formed in the volute 210, such that the airflow enters the volute 210 from the air inlet of the volute 210, and flows out of the volute 210 from the air outlet 250 of the volute 210. The volute 210 includes a curved surface portion and a straight surface portion, both of the curved surface portion and the straight surface portion enclose an accommodating cavity for accommodating the wind wheel 220, and an air outlet duct communicating with the accommodating cavity. The air outlet is located at one end of the air outlet duct away from the accommodating cavity. The direction of the air outlet determines the direction in which the air is discharged from the volute 210. The direction of the air outlet of the volute 210 is inclined towards the bottom of the installation cavity, so that the air outlet direction of the volute 210 is blown out obliquely towards the bottom of the installation cavity.

There are many ways to realize the downward inclination of the air outlet 250, and an example is given below for description.

The top of the volute 210 has a curved surface segment 211 and a straight surface segment 212 connected with the curved surface segment 211, and the straight surface segment 212 slopes downward relative to a tangent to a top of the curved surface segment 211. Thus, when the airflow flows out of the air outlet duct, it first flows along the curved surface segment 211 of the volute 210, and then flows along the straight surface segment 212 of the volute 210, so as to flow downwardly obliquely. The curved surface segment 211 is smoothly connected with the straight surface segment 212, such that the airflow can smoothly flow downwardly obliquely.

The first heat exchanger 510 is extended from a bottom of the volute 210 to a top of the volute 210, such that the first heat exchanger 510 is obliquely provided in the installation cavity, and a higher side of the first heat exchanger 510 is close to the top of the volute 210, and a lower side of the first heat exchanger 510 is close to the bottom of the installation cavity, and even directly connected to the bottom of the installation cavity. In this way, the airflow blown out from the volute 210 has a component extending along the air inlet side of the first heat exchanger 510, so that the airflow can sufficiently pass through various positions of the first heat exchanger 510. An air inlet cavity is formed between the volute 210, the first heat exchanger 510, and the bottom of the installation cavity, such that the airflow flowing out of the volute 210 needs to pass through the first heat exchanger 510 before being discharged from the air outlet of the air duct, that is, the airflow needs to exchange heat with the first heat exchanger 510.

In this embodiment, the air outlet 250 of the volute 210 is inclined towards the bottom of the installation cavity, and the first heat exchanger is inclined along the inclination trend of the air outlet 250 of the volute 210, such that the airflow out of the volute 210 has a component that flows along the air inlet side of the first heat exchanger 510, the airflow can fill the air inlet side of the first heat exchanger 510 and pass through the first heat exchanger 510 under the action of the horizontal component of the airflow, and the heat exchange time and heat exchange efficiency between the air and the first heat exchanger 510 are greatly improved, which is beneficial to improve the energy efficiency of the air conditioner. Since the air outlet of the volute 210 is inclined downward, the downward angle of the first heat exchanger 510 can be reduced (the angle with the bottom of the housing 100 is increased). Thus, the installation of the first heat exchanger 510 is facilitated (the horizontal distance between the center of gravity of the first heat exchanger 510 and the support position of the bottom of the first heat exchanger 510 is reduced). The inclination of the first heat exchanger 510 is beneficial to increase the heat exchange area of the first heat exchanger 510, thereby increasing the heat exchange efficiency.

In some embodiments, in order to ensure that the airflow flows along the air inlet side of the first heat exchanger 510 and fills the first heat exchanger 510, an angle between a direction of the air outlet 250 of the volute 210 and an inclination direction of the first heat exchanger 510 is at least 135° and no more than 150°. Within this angle range, it can be ensured that the airflow blown out from the volute 210 fills the first heat exchanger 510, and a large amount of the airflow will not directly blow the bottom of the installation cavity. When the angle is less than 135°, it is difficult for the airflow out of the volute 210 to fill the air inlet side of the first heat exchanger 510, so that the amount of the air passing through the bottom of the first heat exchanger 510 is significant small, and the utilization rate of the bottom of the first heat exchanger 510 is reduced. When the angle is greater than 150°, the airflow out of the volute 210 partially flows to the bottom of the air duct, the amount of air passing through the bottom of the first heat exchanger 510 is significantly large, resulting in poor heat exchange effect and at the same time reducing the utilization rate of the upper portion of the first heat exchanger 510.

There are many ways to realize that the angle between a direction of the air outlet 250 of the volute 210 and the inclination direction of the first heat exchanger 510 is at least 135° and no more than 150°. An example is given below for description.

The top of the volute 210 has a curved surface segment 211 and a straight surface segment 212 connected with the curved surface segment 211, an angle $\alpha$ between the straight surface segment 212 and a tangential plane at a top of the curved surface segment 211 is at least 5° and not more than 10°; and/or an angle $\beta$ between the first heat exchanger 510 and the bottom of the installation cavity is at least 40° and no more than 50°.

The angle between the straight surface segment 212 and the tangent plane at the top of the curved surface segment 211 should not be too small. When the angle is less than 5°, the first heat exchanger 510 must be deflected by a larger angle in order to satisfy the better heat exchange efficiency, which makes it difficult to install the first heat exchanger 510, and will also lead to an increase in the width dimension occupied by the first heat exchanger 510, and is not conducive to the reasonable utilization of space. The angle between the straight surface segment 212 and the tangent plane at the top of the curved surface segment 211 should not be too large. When the angle is greater than 10°, too many tangent planes at the top of the offset curved surface segment 211 are facing the housing, such that when the airflow flows from the curved surface segment 211 to the straight surface segment, a large deviation will be generated, resulting in excessive pressure loss of the airflow, which is not conducive to the efficient operation of the fan 200.

The angle between the first heat exchanger 510 and the bottom of the installation cavity should not be too small. When the angle is less than 40°, the lower end of the first heat exchanger 510 is far away from the air outlet of the volute 210, which is unfavorable for the airflow in the volute 210 to flow to the bottom of the air inlet side of the first heat exchanger 510, will reduce the utilization rate of the bottom of the first heat exchanger 510, and is not conducive to the installation of the first heat exchanger 510, and will also lead to an increase in the width dimension occupied by the first heat exchanger 510, which is not conducive to the reasonable utilization of space. The angle between the first heat exchanger 510 and the bottom of the installation cavity should not be too large. When the angle is greater than 50°, the heat exchange area of the first heat exchanger 510 will be reduced, and at the same time, the time for flowing out of the volute 210 and passing through the upper portion of the first heat exchanger 510 will be shortened, which is not conducive to the heat exchange between the airflow and the first heat exchanger 510.

The air conditioner indoor unit further includes a second heat exchanger 520. The second heat exchanger 520 is connected in series or in parallel with the first heat exchanger 510 in a refrigerant loop of an air conditioner, and the second heat exchanger 520 is located on a side of the first heat exchanger 510 away from the volute 210. When the first heat exchanger 510 is cooling and the second heat exchanger 520 is heating, the air conditioner indoor unit can realize dehumidification and reheating, and can dehumidify the air without affecting the use of users by temperature changes. The second heat exchanger 520 is provided on the side of the first heat exchanger 510 facing away from the volute 210, so that the airflow is dehumidified first and then heated, which is beneficial to improve the dehumidification efficiency. An angle between the second heat exchanger 520 and the bottom of the housing 100 is y, and y is taken as an example of being 90 degrees.

In some embodiments, in order to improve the compactness of the structure of the air conditioner indoor unit, the second heat exchanger 520 is provided vertically. In this way, on the premise of ensuring the heat exchange efficiency, the arrangement among the fan 200, the first heat exchanger 510 and the second heat exchanger 520 is compact, which is beneficial to improve the space utilization rate of the indoor unit.

In some embodiments, in order to further improve the convenience and stability of the installation of the first heat exchanger 510 and the second heat exchanger 520, the air conditioner indoor unit further includes a connection plate 530, one side of the connection plate 530 is fixedly connected with a first side plate 511 of the first heat exchanger 510, and another side of the connection plate 530 is fixedly connected with a second side plate of 521 the second heat exchanger 520.

In this embodiment, the first heat exchanger 510 includes a first refrigerant pipe and a first side plate 511 connected to the first refrigerant pipe, and the second heat exchanger 520 includes a second refrigerant pipe and a second side plate 521 connected to the second refrigerant pipe. The first side of the connection plate 530 is fixedly connected to the first side plate 511, and the second side of the connection plate 530 is fixedly connected to the second side plate 521. The number of the connection plates 530 is two, which are respectively provided on both end surfaces of the first heat exchanger 510 and the second heat exchanger 520 and correspond to the first side plate 511 and the second side plate 521, respectively. The first heat exchanger 510, the second heat exchanger 520 and the connection plate 530 can form a module, and the three can be assembled first and then installed into the housing 100. As such, since the operable space has been greatly increased, it is not only beneficial to greatly improve the installation efficiency of the three, and connecting the first heat exchanger 510 and the second heat exchanger 520 through the mounting plate 111 can also effectively ensure the relative positional relationship (angle) between the first heat exchanger 510 and the second heat exchanger 520. When the second heat exchanger 520 is set to be vertical, it is simple and convenient to ensure the off-angle of the first heat exchanger 510 relative to the bottom of the housing 100. Therefore, it is beneficial to improve the installation accuracy of the first heat exchanger 510 and ensure the heat exchange effect of the heat exchanger.

There are many ways to fix the connection plate 530 and the first side plate 511 and the second side plate 521. In order to make full use of space and improve connection reliability, the connection plate 530 is in parallel with the first side plate 511 and the second side plate 521, the first side plate 511 and the second side plate 521 are provided with installation holes for installing a refrigerant pipe, fastening lugs 531 are respectively provided on adjacent or opposite sides of the connection plate 530, and the fastening lugs 531 are extended between two adjacent installation holes and are fastened to the corresponding side plates through fasteners.

In this embodiment, the fastening lugs 531 are provided on the first side and the second side of the connection plate 530. The U-shaped refrigerant pipe is connected to the straight refrigerant pipe, and there is a gap for the fastening lugs 531 to be installed between two adjacent U-shaped pipes. The fastening lugs 531 are attached to the first side plate 511 or the second side plate 521, and the two are connected by fastening screws, bolts, or buckles. In this way, the reliability and installation accuracy between the first side plate 511, the second side plate 521 and the connection plate 530 are greatly improved.

It should be noted that, in some embodiments, in order to ensure the relative positional relationship between the volute 210 and the first heat exchanger, the indoor unit further includes a fastening plate 270, the air outlet end of the volute 210 is mounted on the fastening plate 270, and the fastening plate 270 is fixedly connected with the housing. The fastening plate 270 has a fastening opening for the air outlet end of the volute 210 to be installed. Through the arrangement of the fastening plate 270, the installation accuracy of the volute 210 is guaranteed, thereby further ensuring the relative positional relationship between the volute 210 and the first heat exchanger 510.

In some embodiments, in order to further improve the installation stability of the first heat exchanger 510 and the second heat exchanger 520, one or more of the connection plate 530, the first side plate 511 and the second side plate 521 are fixedly connected to the end of the housing 100. One or more of the connection plate 530, the first side plate 511, and the second side plate 521 are fastened to the end plate 110 of the housing 100, and the fastening method includes screw connection, snap connection, and the like. The end plate 110 of the housing 100 corresponding to the connection plate 530, the first side plate 511 and the second side plate 521 is a pressing pipe plate 112, and the pressing pipe plate 112 is a part of the housing 100. In some embodiments, the pressing pipe plate 112 can be a fastening plate independent from the housing 100.

A bottom of the first heat exchanger 510 and/or a bottom of the second heat exchanger 520 is fixedly connected to a bottom of the housing. There are many ways for the first heat exchanger 510 and the second heat exchanger 520 to be fixedly connected to the bottom of the housing, such as fastened connection by screws, fixed connection by snaps, and so on. In some embodiments, the air conditioner indoor unit further includes a water receiving tray 700 located directly below the first heat exchanger 510, and the water receiving tray 700 is fixedly connected to the bottom of the housing. At this time, the bottom of the first heat exchanger 510 can be connected to the water receiving tray 700.

In some embodiments, in order to allow the air conditioner indoor unit to quietly humidify the air, the air conditioner indoor unit includes:

- a housing 100 defined with an air inlet, an air outlet, and an air duct communicating the air inlet with the air outlet;
- a humidification assembly including a steam generating device and a humidification pipe 400, one end of the humidification pipe 400 away from the steam generating device extending into the air duct; and
- a muffler 300 provided between the steam generating device and the humidification pipe 400, or provided on the humidification pipe 400.

For example, in this embodiment, there are many forms of steam generating devices, for example, water can be changed into steam by ultrasonic. A steam generator can also be provided. The steam generator has a steam cavity. A heating element is provided in the steam cavity, and when the temperature of the heating element reaches a preset temperature, water is injected into the heating element, so that the water forms high-pressure water vapor. The heating pipe can be in many forms, and can be a soft pipe or a rigid pipe, and a number of humidification holes are defined on the pipe wall of the humidification pipe 400. After being vaporized or atomized by the steam generating device, the water vapor is guided through the humidification pipe 400, flows out from the humidification hole, enters the air duct, and is finally discharged into the room together with the airflow. No matter what kind of humidification method, it will bring certain noise. In this case, in order not to affect the use of the user, the muffler 300 is installed on the transmission path of the steam to avoid the spread and diffusion of noise.

Taking the muffler 300 provided between the steam generating device and the humidification pipe 400 as an example, the water inlet end of the steam generating device obtains liquid water. After the liquid water is converted into water vapor through the steam generating device, it passes through the muffler 300, and the air inlet end of the humidification pipe 400 is communicated with the muffler 300, so that the steam enters the air duct through the humidification pipe 400. There are many forms of the muffler 300, taking the muffler pipe as an example. After the steam flows out of the steam generating device, it enters the humidification pipe 400 through the muffler pipe.

In this embodiment, the steam generating device and the muffler 300 are provided, such that the steam flows out of the steam generating device, after passing through the muffler 300, enters the humidification pipe 400, and enters the housing 100 through the humidification pipe 400. After the steam flows out of the humidification hole, it enters the air duct, and then enters the room together with the airflow to humidify the room. During this process, the muffler 300 reduces the noise generated by the generation and transmission of steam, so that the air conditioner can humidify the air quietly.

In some embodiments, in order to prevent steam or water droplets (formed by steam condensation) from flowing back into the muffler 300 or the steam generating device, the humidification pipe 400 extends along the length direction of the housing 100, and one end away from the muffler 300 is inclined toward the bottom of the housing 100. In this way, the water droplets can only flow along the humidification pipe 400 in a direction away from the muffler 300, and finally flow out from the humidification pipe 400, enter the water receiving tray 700, or flow out of the air conditioner, to avoid backflow of water vapor or water droplets in the humidification pipe 400 to the muffler 300 and the steam generating device.

In order to further prevent backflow, the muffler 300 extends along the length direction or the width direction of the housing 100, and is inclined towards the bottom of the housing 100 near one end of the humidification pipe 400. The muffler 300 can extend along the length direction of the housing 100 or can extend along the width direction of the housing 100. One end of the muffler 300 connected to the humidification pipe 400 is lower than the end of the muffler 300 connected to the steam generating device, such that the steam or water droplets will not flow back into the steam generating device, and water will not be collected in the steam pipeline to avoid the growth of bacteria, which is beneficial to the user's health when using the air conditioner.

In order to improve the convenience of installation and removal of the muffler 300 and the humidification pipe 400, the muffler 300 is fixedly connected to the outer side wall of one end of the housing 100. The muffler 300 is provided outside the housing 100, so that the installation and removal of the muffler 300 is convenient. The humidification pipe 400 extends out of the housing 100 and is connected to the muffler 300. There are many ways to connect the humidification pipe 400 and the muffler 300, such as plug connection, connection through a fastening sleeve, and the like. Since the connection position of the humidification pipe 400 and the muffler 300 is located outside the housing 100, the installation and removal of the humidification pipe 400 are convenient.

In some embodiments, in order to improve the space utilization rate and the compactness of the structure, and improve the convenience of assembling and disassembling the muffler 300, the steam generating device is installed inside the housing 100, and the exhaust pipe of the steam generating device extends out of the housing 100 and is connected to the end of the muffler 300 away from the humidification pipe 400. The connection position of the muffler 300 and the steam generating device is provided outside the housing 100, and the muffler 300 and the steam generating device can be separated without opening the housing 100.

In some embodiments, in order to improve the adaptability and capability integrity of the air conditioner indoor unit, the air conditioner indoor unit further includes a siphon device 600, the drain end of the siphon device 600 is communicated with the steam generating device through a drainpipe, and the water inlet end of the siphon device 600 is used to communicate with the water source. The siphon device 600 is used for conveying water to the steam generating device, and can be in various forms, such as a water pump and the like. With the arrangement of the siphon device 600, the air conditioner indoor unit has the ability to release water for the steam generating device, so as to supply water to the steam generating device of the air conditioner indoor unit without relying on external equipment, such that the air conditioner indoor unit can humidify the air in more occasions.

There can be many forms of water sources, an additional water tank can be provided, water can also be absorbed from the outside, and the water in the water receiving tray 700 can also be collected by the air conditioner indoor unit. The air conditioner indoor unit further includes a water receiving tray 700, and the water receiving tray 700 has a drain end. The siphon device 600 is disposed near the drain end of the water receiving tray 700, and the water inlet end of the siphon device 600 communicates with the water receiving tray 700. The overall shape of the water receiving tray 700 can be various, taking a rectangular tray as an example, the water receiving tray 700 is provided below the indoor heat exchanger 500 to receive the condensed water generated in the refrigeration process and the dehumidification and reheating process. One end of the water receiving tray 700 is provided with a drainpipe communicating the water receiving tray 700 and the outside of the water receiving tray 700. The siphon device 600 can be in communication with the water receiving tray 700 through a pipeline, or the water inlet end of the siphon device 600 can be directly provided in the water receiving tray 700, such that the siphon device 600 can absorb the water in the water receiving tray 700 and deliver the water to the steam generating device. In this way, it is beneficial to make full use of the existing structure and resources (the water receiving tray 700), and humidification can be performed without installing a water tank, which greatly simplifies the structure of the air conditioner indoor unit.

When using the water in the water receiving tray 700 for humidification, in order to prevent the siphon device 600 from being unloaded, when the water volume in the water receiving tray 700 is insufficient, the user is promptly reminded to turn off the siphon device 600.

The air conditioner indoor unit further includes a water level switch 710. The water level switch is provided near the siphon device 600, and the water inlet end of the siphon device 600 and the water level switch are located in the water receiving tray 700. The water level switch is electrically connected with the siphon device 600, and the water level switch is used to detect the water level in the water receiving tray 700. When the water level in the water receiving tray 700 is low enough to supply the siphon device 600, the water level switch can directly close the siphon device 600, or send the detected information to the main control circuit of the air conditioner, and the main control circuit controls the siphon device 600 to stop working. The water level switch can directly trigger a prompting device 720 to work to prompt the user that there is a lack of water. The prompting device may be one or more of a sound prompting device, a light prompting device, a vibration prompting device and a short message prompting.

The drain end of the water receiving tray 700 is provided with a first installation position for installing the water level switch, and a second installation position for installing the water inlet end of the siphon device 600. The first installation position and the second installation position are grooves recessed towards the bottom of the water receiving tray 700, so that the water in the water receiving tray 700 can flow into the first installation position and the second installation position. The first installation position is located upstream of the second installation position, so that the water first flows through the water level switch and then into the siphon device 600, the water level switch can timely control the siphon device 600 according to the detection result, so as to minimize the unloading of the siphon device 600, which is beneficial to protect the siphon device 600.

In some embodiments, in order to improve the convenience of installation and removal of the siphon device 600, one end of the housing 100 has a mounting plate 111, the mounting plate 111 is a part of the housing 100, and the siphon device 600 is mounted on the mounting plate 111. The mounting plate 111 on which the siphon device 600 is installed is used as a part of the housing 100, and the siphon device 600 can be installed and removed without opening the housing 100 during the disassembly process. The mounting plate 111 and the rest of the housing 100 can be connected by means of screws, snaps, and the like. When disassembling the siphon device 600, the cooperation between the mounting plate 111 and the housing 100 can be disengaged, and the mounting plate 111 and the siphon device 600 can be taken out together. When installing the siphon device 600, the mounting plate 111 and the siphon device 600 can be inserted into the housing 100 together, and the mounting plate 111 and the rest of the housing 100 can be fastened. In this way, the disassembly and installation of the siphon device 600 is facilitated.

In some embodiments, in order to improve the installation stability of the heat exchanger and the installation stability of the siphon device 600, one end of the housing 100 also has a pressing pipe plate 112, and the pressing pipe plate 112 is provided corresponding to one end of the indoor heat exchanger 500 of the air conditioner indoor unit. The pressing pipe plate 112 and the mounting plate 111 are spliced together to form part of the end plate 110 of the housing 100. As a part of the end plate 110 of the housing 100, the pressing pipe plate 112 extrudes the U-shaped refrigerant pipe, or is connected with the side plate of the indoor heat exchanger 500, and is used for installing and fixing the indoor heat exchanger 500. The pressing pipe plate 112 and the mounting plate 111 are connected by means of screws, buckles, etc., so that the mounting plate 111 and the pressing pipe plate 112 are mutually limited and fixed, and the installation stability of the two is improved.

In some embodiments, in order to make the space of the housing 100 more reasonable and improve the compactness of the structure, the siphon device 600 and the muffler 300 are located at opposite ends of the housing 100, respectively. In this way, the siphon water source and atomization, noise reduction and humidification are located at opposite ends of the housing 100, which is beneficial for installing the above-mentioned devices in the gaps between the housing 100 and the heat exchanger, and between the housing 100 and the wind wheel 220. Therefore, the space inside and outside the housing 100 is fully utilized, which is beneficial to improve the utilization rate of the space. The siphon device 600 communicates with the steam generating device through a hose to expose the water source.

It should be noted that in some embodiments, the siphon device 600, the humidification assembly and the muffler 300 can be regarded as an integral module, which can be set as an optional configuration. When the user needs, the siphon device 600, the humidification assembly and the muffler 300 can be easily added to the housing 100 or inside the housing 100 due to the convenience of disassembly of the humidification assembly, the muffler 300 and the siphon device 600. In this way, the functions of the air conditioner indoor unit can be adjusted according to the needs of different users, so as to meet the needs of different users, which is beneficial to improve the adaptability of the air conditioner indoor unit.

The present disclosure further provides an air conditioner, including an outdoor unit and an air conditioner indoor unit. The specific structure of the air conditioner indoor unit refers to the above-mentioned embodiment. Since the air conditioner adopts all the technical solutions of all the above-mentioned embodiments, it has at least all the beneficial effects brought by the technical solutions of the above-mentioned embodiments, and will not be repeated herein. The outdoor unit and the indoor unit are connected through a refrigerant pipe to form a refrigerant circulation system.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. An air conditioner indoor unit comprising:

a housing provided with an installation cavity;

a volute provided in the installation cavity, an air outlet of the volute being inclined towards a bottom of the installation cavity;

a first heat exchanger provided in the installation cavity corresponding to the air outlet, the first heat exchanger being extended from a bottom of the volute to a top of the volute, to form an air inlet cavity defined by the volute, the first heat exchanger and the bottom of the installation cavity, an airflow out of the volute to fill an air inlet side of the first heat exchanger and pass through the first heat exchanger, an angle between the first heat exchanger and the bottom of the installation cavity being at least 40° and no more than 50°; and a second heat exchanger provided in the installation cavity and located on a side of the first heat exchanger away from the volute, the second heat exchanger being connected in series or in parallel with the first heat exchanger in a refrigerant loop of the air conditioner, the airflow passing through the first heat exchanger to pass through the second heat exchanger as an airflow output, an angle between the second heat exchanger and the bottom of the installation cavity being 90°.

2. The air conditioner indoor unit of claim 1, wherein the top of the volute has a curved surface segment and a straight surface segment connected with the curved surface segment, and the straight surface segment is sloped downward relative to a tangent to a top of the curved surface segment.

3. The air conditioner indoor unit of claim 2, wherein the curved surface segment is smoothly connected with the straight surface segment.

4. The air conditioner indoor unit of claim 1, wherein an angle between a direction of the air outlet of the volute and an inclination direction of the first heat exchanger is at least 135° and no more than 150°.

5. The air conditioner indoor unit of claim 4, wherein:

the top of the volute has a curved surface segment and a straight surface segment connected with the curved surface segment, an angle between the straight surface segment and a tangential plane at a top of the curved surface segment is at least 5° and not more than 10°.

6. The air conditioner indoor unit of claim 1, further comprising:

a connection plate;

wherein one side of the connection plate is fixedly connected with a first side plate of the first heat exchanger, and another side of the connection plate is fixedly connected with a second side plate of the second heat exchanger.

7. The air conditioner indoor unit of claim 6, wherein:

the connection plate is in parallel with the first side plate and the second side plate, the first side plate and the second side plate are provided with installation holes for installing a refrigerant pipe, fastening lugs are respectively provided on adjacent or opposite sides of the connection plate, and the fastening lugs are extended between two adjacent installation holes and are fastened to corresponding side plates through fasteners.

8. The air conditioner indoor unit of claim 6, wherein one or more of the connection plate, the first side plate and the second side plate are fixedly connected to an end of the housing.

9. The air conditioner indoor unit of claim 1, wherein at least one of a bottom of the first heat exchanger and a bottom of the second heat exchanger is fixedly connected to a bottom of the housing.

10. The air conditioner indoor unit of claim 1, further comprising:

a fastening plate, wherein the air outlet of the volute is mounted on the fastening plate, and the fastening plate is fixedly connected with the housing.

11. An air conditioner comprising:

the air conditioner indoor unit of claim 1; and an outdoor unit communicated with the air conditioner indoor unit through a refrigerant pipe.

12. The air conditioner indoor unit of claim 1, wherein a first working mode of the first heat exchanger is one of to cool and to heat, and wherein a second working mode of the second heat exchanger is one of to cool and to heat.

13. The air conditioner indoor unit of claim 12, wherein:

the first working mode and the second working mode are the same, or the first working mode and the second working mode are different.

14. The air conditioner indoor unit of claim 13, wherein when the first working mode is to cool and the second working mode is to heat, the air conditioner indoor unit provides dehumidification and reheating of the airflow output.

* * * * *